US006106257A

United States Patent [19]

Chen

[11] Patent Number: 6,106,257

[45] Date of Patent: Aug. 22, 2000

[54] HYDRAULIC POWER TRANSMISSION SYSTEM

[76] Inventor: Jen-Hsin Chen, 1F, No. 5, Lane 66, Kuo Sheng I Street, Hua Lien City, Taiwan

[21] Appl. No.: 09/113,498

[22] Filed: Jul. 10, 1998

[51] Int. Cl.[7] ..... F01C 21/00

[52] U.S. Cl. ..... 418/184; 418/175; 418/177; 418/178; 418/136; 418/253

[58] Field of Search ..... 418/175, 177, 418/178, 184, 253, 136

[56] References Cited

U.S. PATENT DOCUMENTS

| | | | |
|---|---|---|---|
| 4,877,384 | 10/1989 | Chu | 418/184 |
| 4,898,524 | 2/1990 | Butzen | 418/136 |
| 5,044,910 | 9/1991 | Sakamaki et al. | 418/253 |
| 5,496,159 | 3/1996 | Devore | 418/178 |

*Primary Examiner*—Thomas Denion
*Assistant Examiner*—Thai-Ba Trieu
*Attorney, Agent, or Firm*—Rosenberg, Klein & Lee

[57] ABSTRACT

A hydraulic power transmission system including a stationary inner barrel connected between a hydraulic oil inlet pipe and a hydraulic oil return pipe and having a plurality of openings spaced around the periphery and a plurality of movable blocks moved in and out of the opening, and two outer barrels fixedly connected together with a gasket ring mounted there between and having a respective series of involute arched guide planes space on the inside and raised one behind another, wherein when a hydraulic oil is forced through the hydraulic oil inlet pipe into the inner barrel, it forces the arched movable blocks out of the opening of the inner barrel and flows through the involute arched guide planes of the outer barrel to push the vertical steps between each two arched guide planes, causing the outer barrels to rotate.

8 Claims, 3 Drawing Sheets

HYDRAULIC POWER TRANSMISSION SYSTEM

BACKGROUND OF THE INVENTION

The present invention relates to power transmission systems, and more particularly to hydraulic power transmission system which uses a hydraulic oil under pressure to push rotary barrels which turn a coupled mechanism.

Motors and engines are most commonly used for turning a rotary motion into a linear or rotary driving power for moving a mechanism. However, when a motor or engine is operated, it consumes large quantities of fuel or electric power and produces large amounts of air or noise pollution, which will result in damaging the earth's environment.

SUMMARY OF THE INVENTION

The present invention has been accomplished to provide a hydraulic power transmission system which eliminates the aforesaid problems. It is one object of the present invention to provide a hydraulic power transmission system which saves fuel consumption. It is another object of the present invention to provide a hydraulic power transmission system which produces low noise pollution when operated. It is still another object of the present invention to provide a hydraulic power transmission system which does not pollute the air when operated.

According to the present invention, the hydraulic power transmission system comprises an stationary barrel connected between a hydraulic oil inlet pipe and a hydraulic return pipe and having a plurality of openings spaced around the periphery, a plurality of movable blocks moved in and out of the openings, and two pressure-extended rotatory outer barrels connected together by screws with a gasket ring mounted there between and having a respective series of involute arched guide planes spaced on the inside and raised one behind another and respectively form a vertical step between each two involute arched guide planes, wherein when a hydraulic oil is forced through the hydraulic oil inlet pipe into the stationary inner barrel, it forces the arched movable blocks out of the opening of the inner barrel and flows thorough the arched guide planes of the outer barrel toward push the vertical steps, causing the outer barrels be forced to rotate, and the rotary power of the outer barrels can then be transmitted to operate a mechanism, such as: the transmission mechanism of a bicycle, motor cycle, machine, etc. A small motor or pump means may be used to pump a hydraulic oil into the system. Make a bicycle example, the hydraulic power transmission system is used in a bicycle, the hydraulic oil inlet pipe is coupled to he bottom bracket bearing axle through a reciprocating mechanism, so that the reciprocating mechanism is reciprocated and the hydraulic oil is forced to circulate in the system when the bicycle rider steps on the treadles to turn the bottom bracket bearing axle, strong rotatory power in oil pressure transmission form will be produced.

DETAILED DESCRIPTION OF THE PREFERRED EMBODIMENT

Figure 1:
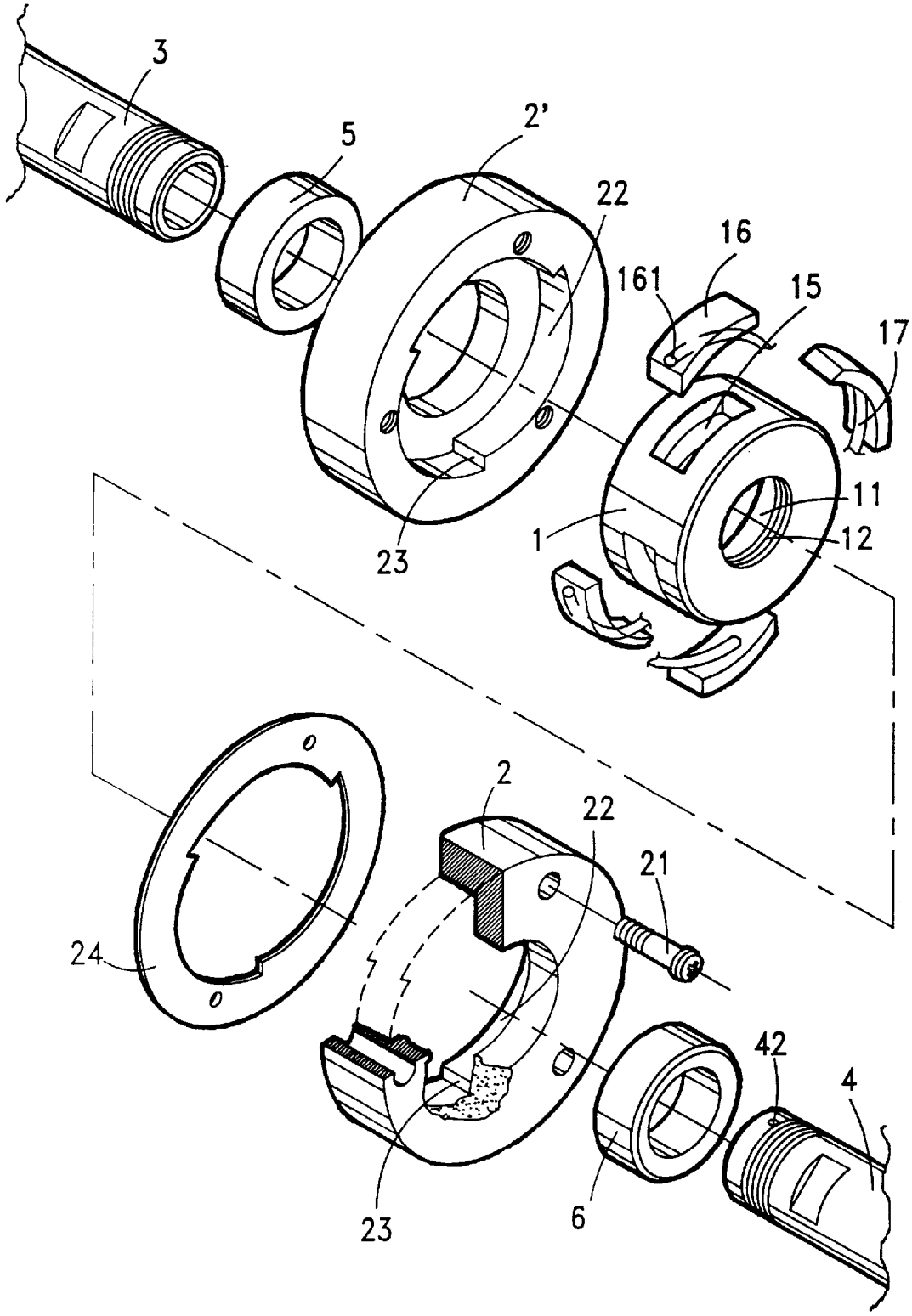
FIG. 1 is an exploded view of a hydraulic power transmission system according to the present invention.

Referring to FIG. 1, a hydraulic power transmission system in accordance with the present invention is generally comprised of a stationary barrel 1, two outer barrels 2, 2' mounted around the inner barrel 1 and longitudinally placed against each other, and a gasket ring 24 mounted around the inner barrel 1 and connected between the outer barrel 2, 2'. The outer barrels 2, 2' and the gasket ring 24 are fastened together by screws 21. The inner barrel 1 comprises a longitudinal center space 11, two reversed inner threads 12, 13 at two opposite ends of the longitudinal center space 11, a plurality of openings 15 spaced around the periphery and which join the longitudinal center space 11, and a plurality of arched movable blocks 16 mounted in the openings 15. The arched movable blocks 16 have bevel side edges that mate with edges of the inner barrel 1 which are also beveled. The arched movable blocks 16 are moved away from the openings 15 and will not fall into the inside of the longitudinal center space 11 due to the bevel edges of the inner barrel 1 when seated. A threaded hydraulic oil inlet pipe 3 and a threaded hydraulic oil return pipe 4 are respectively inserted into the outer barrels 2', 2, and screwed into the inner threads 13, 12 of the stationary inner barrel 1. Two leak-proof bearings 5, 6 are respectively mounted around the hydraulic oil inlet pipe 3 and the hydraulic oil return pipe 4 within the outer barrels 2', 2 and joined against two opposite ends of the inner barrel 1.

Referring to FIG. 1 again, the hydraulic oil return pipe 4 has a close end 41 disposed in the longitudinal center space 11 of the stationary inner barrel 1 to block up one end of the inner barrel 1, and a plurality of radial metering orifices 42 spaced around the periphery adjacent to the close end 41. The arched movable blocks 16 have a respective through hole 161 respectively connected to the radial metering orifices 42 of the hydraulic oil return pipe 4 by a respective flexible oil tube 17. Each outer barrel 2 or 2' having a plurality of arched guide planes 22 respectively formed of a involute space and connected in series around the inside wall to build up a plurality of vertical steps 23 radially raised from the inside wall of the outer barrel 2 or 2' and respectively connected between each two arched guide planes 22.

Figure 2:
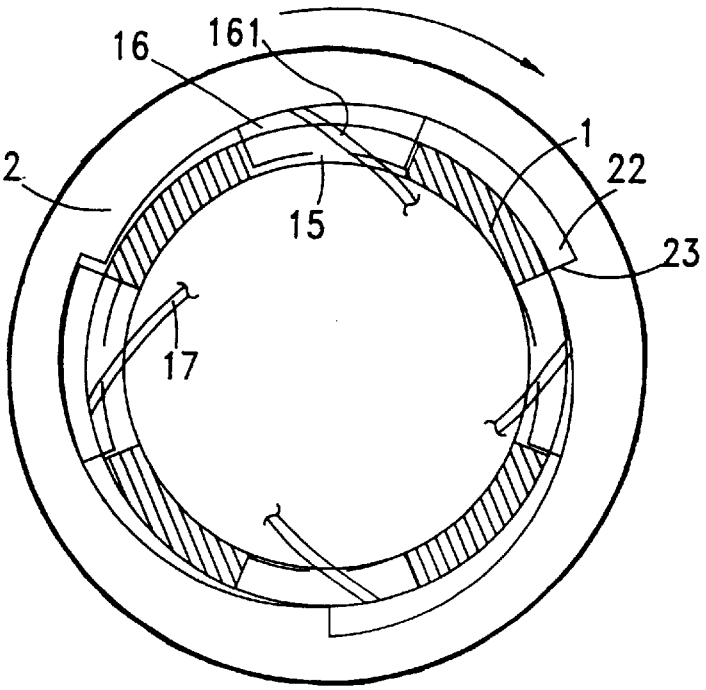
FIG. 2 is a cross sectional view in an enlarged scale of the present invention, showing the outer barrels turned relative to the inner barrel.
Figure 3:
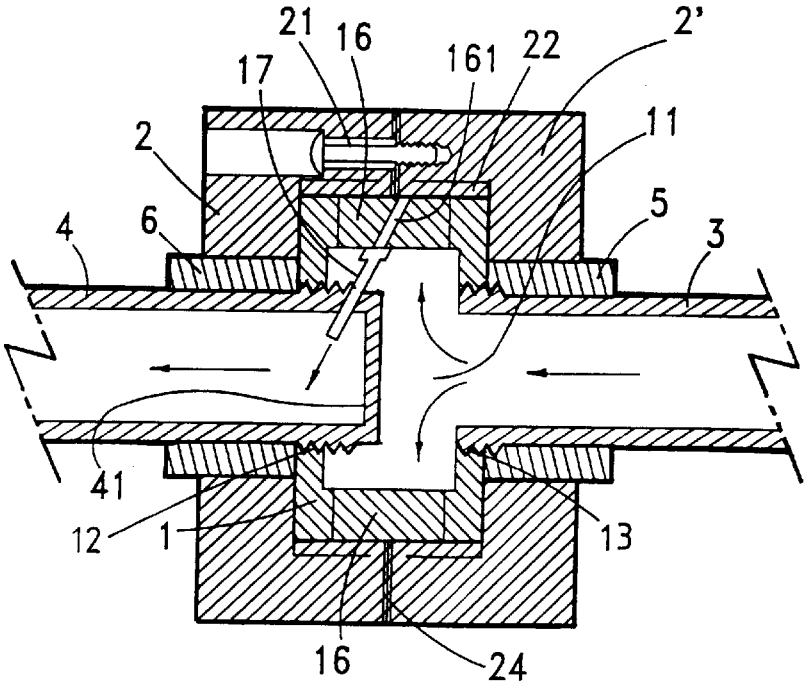
FIG. 3 is a longitudinal view in section of the present invention.

Referring to FIGS. 2 and 3, when a high pressure hydraulic oil is forced through the hydraulic oil inlet pipe 3 into the longitudinal center space 11 of the stationary inner barrel 1 by a pressure source such as a pump (not shown), it is sealed by the close end 41 of the return pipe 4, and forced to flow radially outwards, thereby causing the arched movable blocks 16 to be moved out of the openings 15 of the inner barrel 1. When the openings 15 are opened, the hydraulic oil is forced to flow out of the inner barrel 1 along the arched guide planes 22 toward the vertical steps 23, thereby causing the vertical steps 23 to be pushed by the hydraulic oil, and therefore the outer barrels 2, 2' are rotated. When the outer barrels 2, 2' are rotated, a number of the movable blocks 16 are more than the vertical steps 23 and so the hydraulic oil that flows out of the stationary inner barrel 1 is forced into the through holes 161, then directed through the flexible tubes 17 into the hydraulic oil return pipe 4 through the metering orifices 42 and then directed back to the hydraulic pressure source. The rotary power of the outer barrels 2, 2' can then be applied to operate a piece of mechanism or another useful application.

Figure 4:
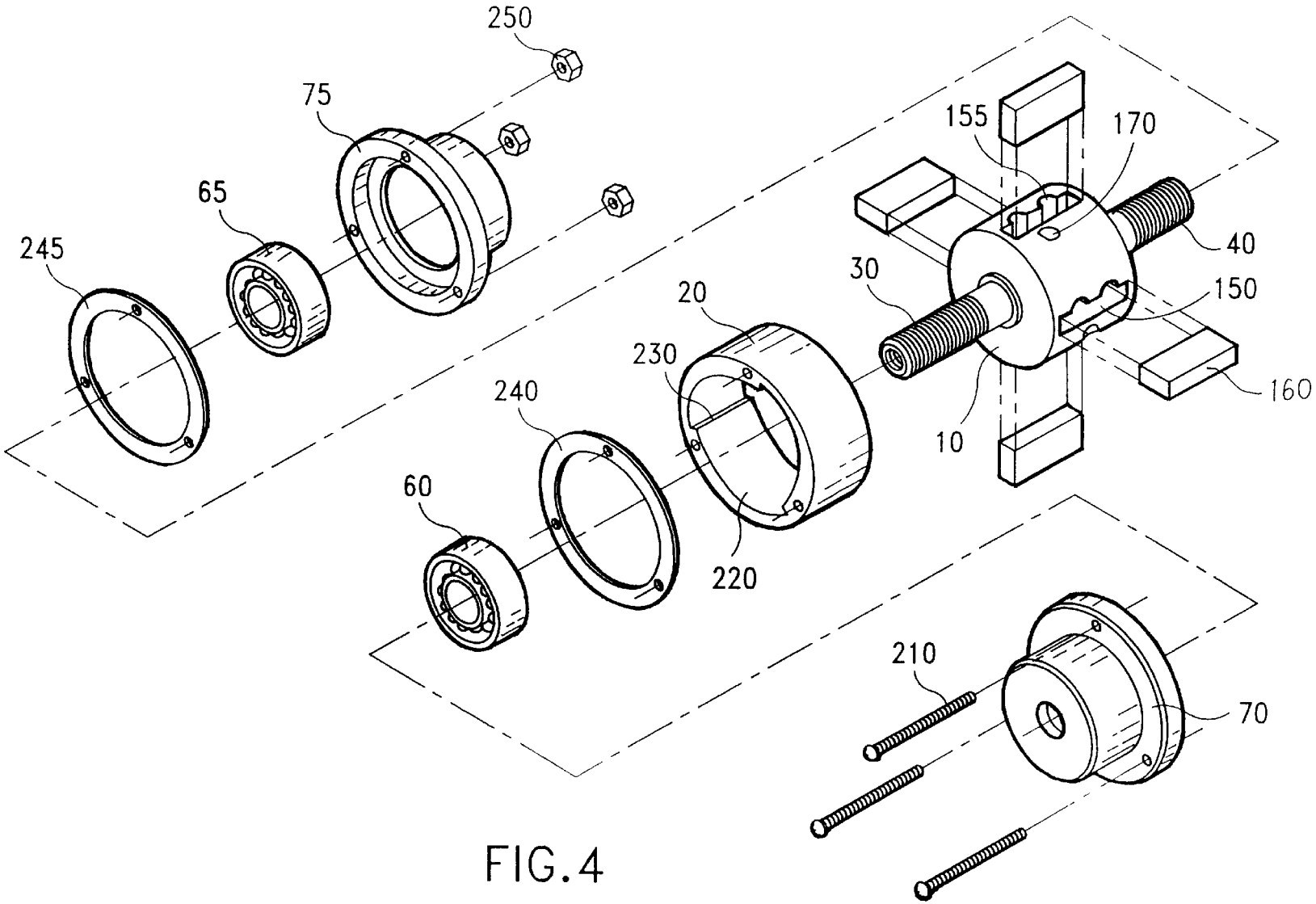
FIG. 4 is an exploded view of an alternative embodiment for miniaturize form of the present invention.

Referring to FIG. 4, an exploded view of an alternative embodiment which a hydraulic power transmission system for miniaturize form in accordance with the present invention is comprised of a stationary and solid inner barrel 10, a outer barrel 20 mounted around the inner barrel 10, two caps 70, 75 longitudinally and separably placed against the outer barrel 20, and two gasket rings 240, 245 mounted a end of the outer barrel 20 and connected between the caps 70, 75 separately. The caps 70, 75, gasket rings 240, 245, and the outer barrel 20 are fastened together by screws 210, 250. The stationary and solid inner barrel 10 comprises a plurality of openings 150 spaced around the periphery which join the longitudinal center, and a plurality of movable blocks a 160 mounted in the openings 150, and then each opening 150 having a plurality of exportable holes 155 which take the hydraulic oil flow out of the inner barrel 10. A threaded hydraulic oil inlet tube 30 is inserted into the longitudinal center of the inner barrel 10, and a threaded hydraulic oil return tube 40 closed and fastened on another end of the inner barrel 10. Two leak-proof bearings 60, 65 are respectively mounted around the threaded hydraulic oil inlet tube 30 and the threaded hydraulic oil return tube 40 within the caps 70,75, and joined against two opposite ends of the inner barrel 10. The inner barrel 10 has a plurality of through holes 170 respectively inward connected to the threaded hydraulic oil return tube 40 by through the entity of the inner barrel 10. The outer barred 20 having a plurality of arched guide planes 220 respectively formed of a involute space and connected in series around the inside wall to build up a plurality of vertical steps 230 radially raised from the inside wall of the outer barrel 220. A number of the movable blocks 160 are more than the vertical steps 230, so half of the movable blocks 160 are moved away from the opening 150 and another half of the movable blocks 160 are failed into the inside of the opening 150 momentarily, and the hydraulic oil that flows out of the stationary inner barrel 10 is forced into the holes 170, then directed the holes 170 into the hydraulic oil return tube 40 and then directed back to the hydraulic pressure source. The rotary power of the outer barred 20 and the caps 70,75 can then be applied to operate piece of mechanism or another useful application too.

While only preferred embodiment of the present invention has been shown and described, it will be understood that various modifications and changes could be made thereunto without departing from the spirit and scope of the invention disclosed.

What the invention claimed is:

1. A hydraulic power transition system comprising:

a stationary inner barrel having a plurality of openings spaced around the periphery, each said opening having a plurality of exportable holes and through holes, and a plurality of arched movable blocks moved in and out of said openings;

an outer barrel mounted around said stationary inner barrel, said outer barrel comprising a plurality of involute arched guide planes connected in series around an inside wall thereof to build up a plurality of vertical steps radially raised from the inside wall;

two caps longitudinally and separably placed against the ends of said outer barrel;

two gasket rings fixedly and respectively connected between said outer barrel and said caps;

a hydraulic oil inlet tube inserted into one end of said inner barrel and adapted for guiding a high pressure hydraulic oil from a pressure source into said inner barrel; and a hydraulic oil return tube closed and fastened on another end of said inner barrel, and adapted for guiding said hydraulic oil from said involute arched guide planes back to said hydraulic pressure source via said hydraulic oil return tube;

wherein when a hydraulic oil is forced through said hydraulic oil inlet tube into said inner barrel been stopped by said hydraulic oil return tube, and forced to move said movable blocks out of said openings of said inner barrel by said exportable holes, and then to flow out of said openings of said inner barrel along said involute arched guide planes of said outer barrel toward said vertical steps, thereby causing said vertical steps to be pushed by said hydraulic oil, and therefore said outer barrel and said caps are rotated to operate a mechanism coupled thereto.

2. The hydraulic power transmission system of claim 1 further comprising a pressure source controlled to force said hydraulic oil into said hydraulic oil inlet tube.

3. The hydraulic power transmission system of claim 1 further comprising two leak-proof bearings respectively mounted around said hydraulic oil inlet tube and said hydraulic oil return tube within said two caps.

4. The hydraulic power transmission system of claim 1 wherein a number of said movable blocks are more than said vertical steps.

5. The hydraulic power transmission system of claim 1 wherein said stationary inner barrel is solid inner barrel.

6. The hydraulic power transmission system of claim 5 further comprising a pressure source controlled to force said hydraulic oil into said hydraulic oil inlet tube.

7. The hydraulic power transmission system of claim 5 further comprising two leak-proof bearings respectively mounted around said hydraulic oil inlet tube and said hydraulic oil return tube within said two caps.

8. The hydraulic power transmission system of claim 5 wherein a number of said movable blocks are more than said vertical steps.

* * * * *